US011725829B2

(12) United States Patent
Mueller et al.

(10) Patent No.: US 11,725,829 B2
(45) Date of Patent: Aug. 15, 2023

(54) METHOD FOR OPERATING A COOKING SYSTEM, AND HOB AND COOKWARE

(71) Applicant: Miele & Cie. KG, Guetersloh (DE)

(72) Inventors: Christoph Mueller, Roedinghausen (DE); Britta Hoelscher, Hannover (DE); Ina Laukoetter, Guetersloh (DE); Jens Keunecke, Bielefeld (DE); Till Deutschmann, Bielefeld (DE); Daniel Ebke, Bielefeld (DE)

(73) Assignee: MIELE & CIE. KG, Guetersloh (DE)

( * ) Notice: Subject to any disclaimer, the term of this patent is extended or adjusted under 35 U.S.C. 154(b) by 0 days.

(21) Appl. No.: 17/768,497

(22) PCT Filed: Sep. 9, 2020

(86) PCT No.: PCT/EP2020/075141
§ 371 (c)(1),
(2) Date: Apr. 13, 2022

(87) PCT Pub. No.: WO2021/078439
PCT Pub. Date: Apr. 29, 2021

(65) Prior Publication Data

US 2022/0364734 A1 Nov. 17, 2022

(30) Foreign Application Priority Data

Oct. 21, 2019 (DE) ..... 10 2019 128 303.5

(51) Int. Cl.
*F24C 7/08* (2006.01)
*H05B 6/12* (2006.01)

(52) U.S. Cl.
CPC ..... *F24C 7/083* (2013.01); *H05B 6/1209* (2013.01); *H05B 2213/06* (2013.01)

(58) Field of Classification Search
CPC ... H05B 6/00; H05B 6/02; H05B 6/06; H05B 6/062; H05B 6/10; H05B 6/12; H05B 6/1209; H05B 6/1218; H05B 2206/02
(Continued)

(56) References Cited

U.S. PATENT DOCUMENTS 11,041,628 B2 6/2021 Egenter et al.
2012/0000903 A1* 1/2012 Baarman ..... H05B 6/1236 219/620

(Continued)

FOREIGN PATENT DOCUMENTS

DE 102004011749 A1 9/2005
EP 2276322 A1 1/2011

(Continued)

*Primary Examiner* — Sang Y Paik
(74) *Attorney, Agent, or Firm* — Leydig, Voit & Mayer, Ltd.

(57) ABSTRACT

A method for operating a cooking system, the cooking system including a hob, cookware, and a mobile device, includes: transmitting a process instruction from the mobile device to the hob; receiving the process instruction from the mobile device by the hob; transmitting a confirmation request from the hob to the cookware; in response to a confirmation by a user on the cookware, transmitting a confirmation message from the cookware to the hob; and in response to the hob receiving the confirmation message from the cookware, executing the process instruction of the mobile device by the hob.

13 Claims, 2 Drawing Sheets

(58) Field of Classification Search
USPC ..... 219/620–627, 443.1–448.13
See application file for complete search history.

(56) References Cited

U.S. PATENT DOCUMENTS

| | | | | |
|---|---|---|---|---|
| 2015/0042453 | A1* | 2/2015 | Beifuss ..... | G08C 17/02 340/12.5 |
| 2017/0243515 | A1* | 8/2017 | Vengroff ..... | A47J 36/321 |

FOREIGN PATENT DOCUMENTS

| | | | |
|---|---|---|---|
| EP | 3225143 | A1 | 10/2017 |
| EP | 3340201 | A1 | 6/2018 |
| EP | 3416457 | A1 | 12/2018 |
| EP | 3489583 | A1 | 5/2019 |
| WO | WO 2007107888 | A2 | 9/2007 |
| WO | WO 2015128578 | A2 | 9/2015 |
| WO | WO 2016028921 | A1 | 2/2016 |

* cited by examiner

METHOD FOR OPERATING A COOKING SYSTEM, AND HOB AND COOKWARE

CROSS-REFERENCE TO PRIOR APPLICATIONS

This application is a U.S. National Phase application under 35 U.S.C. § 371 of International Application No. PCT/EP2020/075141, filed on Sep. 9, 2020, and claims benefit to German Patent Application No. DE 10 2019 128 303.5, filed on Oct. 21, 2019. The International Application was published in German on Apr. 29, 2021 as WO 2021/078439 under PCT Article 21(2).

FIELD

The invention relates to a method for operating a cooking system as described herein, a hob for carrying out such a method, and cookware for carrying out such a method.

BACKGROUND

The trend in domestic cooking is increasingly towards making the implementation of cooking processes simpler, more convenient and/or more reliable for the user with regard to the desired cooking result. This can be supported by the user being provided with complete automatic programs or assistance functions which are intended to relieve the user of part of the implementation or even the entire implementation of the cooking process. A cooking process can also be supported, for example, by the hob and/or by a mobile device by the cooking process being followed and shown to the user, and the next actions in the recipe sequence being displayed or appropriate instructions being provided to the user on said device.

Hobs are also increasingly disappearing from the kitchen visually. This also includes designing the control elements of the hobs to be increasingly inconspicuous or making them disappear completely. This can lead to moving the control elements of the hobs onto kitchenware. It may therefore be necessary, or at least desirable, that information can be exchanged between the kitchenware and the hob. This may include the transmission of instructions as well as measured variables.

In any case, it should be noted that in the case of a communication between kitchenware or cookware and a hob or hotplate or the like via a radio transmission, e.g. by means of transponder technology, it must be taken into account that this can be a remote effect, i.e. open-loop and/or closed-loop control of an appliance by means of a command which can be made out of sight of a device. Communication and associated mutual or at least one-sided influencing can thus take place between the participants, even if they are not in their intended use. In other words, for example, the hob or the hotplate could also be operated by the kitchenware, although the kitchenware is not actually on the hob or on the hotplate. Since this can endanger the safety of the user, such remote effects in the home must be prevented in accordance with the DIN EN 60335-2-6 (VDE 0700-1) standard.

EP 3 416 457 A1 describes a method for operating an inductive cooking system, the inductive cooking system comprising a hob having at least one first hotplate and at least one receiving unit, and at least one piece of kitchenware having at least one actuating element and at least one transmitting unit, the kitchenware being arranged on the first hotplate of the hob, the method comprising at least the steps of:

transmitting a first signal from the transmitting unit of the kitchenware when a user actuates the actuating element of the kitchenware, receiving the first signal by means of the receiving unit of the hob, evaluating the received first signal by means of the hob, inductively operating at least the first hotplate of the hob at a first predetermined power for a predetermined period of time depending on the evaluation of the received first signal, transmitting a second signal from the transmitting unit of the kitchenware when the kitchenware is inductively supplied by the first hotplate, receiving the second signal by means of the receiving unit of the hob, and evaluating the received second signal by means of the hob.

The method of EP 3 416 457 A1 is based on the concept that, in this way, the user only has to actuate the actuating element of the kitchenware once in order to initialize the entire further sequence of the method. This allows the method or a corresponding piece of kitchenware to function with only one actuating element to start and carry out the method according to the invention.

This is possible because a pairing between the hob or the hotplate thereof and the kitchenware is triggered by the user actuating the actuating element of the kitchenware once, which leads to a connection between the hotplate and the kitchenware. In other words, when the user actuates the actuating element of the kitchenware once, a signal is sent back from the hotplate to the kitchenware, which triggers a reaction by the kitchenware that leads to a successful pairing of the kitchenware and the hob or hotplate. This successful pairing can be used by the hob as a trigger, for example to carry out an automated cooking process for this hotplate. As a result, this automated cooking process can be triggered by the user by actuating the actuating element of the kitchenware once.

The method can in this case be implemented in accordance with standards while preventing a remote effect by the hotplate using an inductive power as the transmitted signal of the pairing, the reception of which signal by the kitchenware only triggers the transmission of the second signal by said kitchenware. Because the inductive power of the hotplate can only be absorbed by the kitchenware if there is direct contact or a maximum distance of approx. 5 cm between the hotplate or the coil thereof and the kitchenware, the pairing can only be successful if this general condition is met. Otherwise, no pairing takes place and the automated cooking process is not started.

EP 3 340 201 A1 describes a method for operating a domestic appliance, which can in particular be a hob and an extractor hood, using a mobile device, the method comprising the following steps:

receiving a process instruction from the mobile device on the domestic appliance; and controlling the domestic appliance according to the process instruction, the process instruction being executed in response to a release signal triggered by a user on the domestic appliance.

In this case, the actuation of the release signal can be triggered using a manually operable release switch on the domestic appliance.

In this way, a cooking process of a hob can be supported by a mobile device or an app running thereon, and direct process instructions can also be transmitted from the mobile device to the hob for this purpose. However, in order to prevent a remote effect in this case, the process instructions received by the hob are only carried out by the hob if they are released or confirmed on the hob by the user.

In the case of the method from EP 3 340 201 A1, it is therefore necessary for the user to confirm each process instruction from the mobile device or the app thereof on the hob. This can be perceived as very inconvenient by the user and negates some of the convenience offered by the mobile device or the app thereof supporting the cooking process.

A particular disadvantage is that the assignment of the process instruction to be confirmed by the user to the individual hotplates of the hob is confusing for the user, and the assignment to the individual hotplates of the hob cannot be carried out intuitively or with absolute certainty. This can in particular be the case if a plurality of hotplates of the hob are operated in parallel for the dish to be prepared. This can also negate some of the convenience offered by the mobile device or the app thereof supporting the cooking process. This can also lead to operating errors if the user confuses the hotplates of the hob and assigns the process instruction to be confirmed to an incorrect hotplate and confirms said process instruction.

SUMMARY

In an embodiment, the present invention provides a method for operating a cooking system, the cooking system comprising a hob, cookware, and a mobile device, the method comprising: transmitting a process instruction from the mobile device to the hob; receiving the process instruction from the mobile device by the hob; transmitting a confirmation request from the hob to the cookware; in response to a confirmation by a user on the cookware, transmitting a confirmation message from the cookware to the hob; and in response to the hob receiving the confirmation message from the cookware, executing the process instruction of the mobile device by the hob.

BRIEF DESCRIPTION OF THE DRAWINGS

Subject matter of the present disclosure will be described in even greater detail below based on the exemplary figures. All features described and/or illustrated herein can be used alone or combined in different combinations. The features and advantages of various embodiments will become apparent by reading the following detailed description with reference to the attached drawings, which illustrate the following.

DETAILED DESCRIPTION

Figure 1:
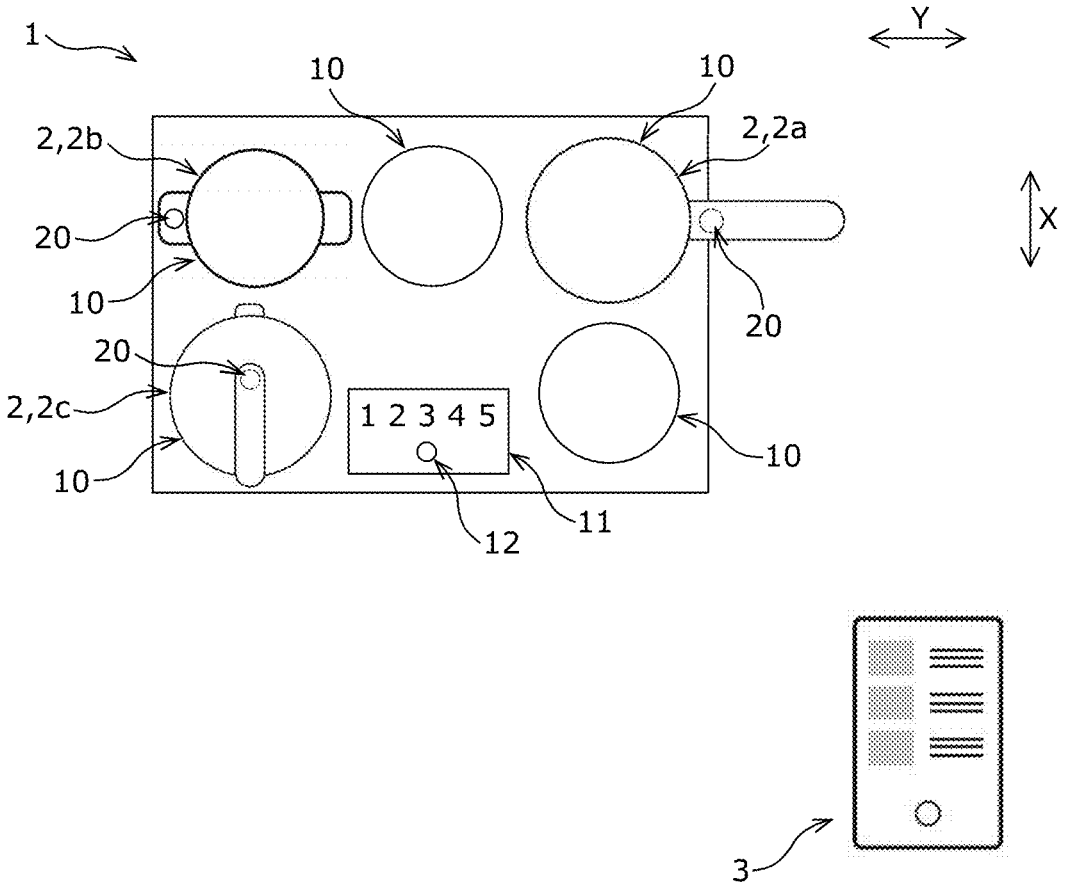
FIG. 1 is a schematic view of a cooking system for carrying out a method according to the invention from above.

In an embodiment, the present invention provides a method for operating a cooking system of the type described at the outset, such that the convenience of supporting a cooking process by means of a mobile device can be increased. It is intended to be possible to prevent a remote effect in this case. At the very least, an alternative to known methods of this type for operating a cooking system is to be provided.

In an embodiment, the invention, provides a method for operating a cooking system as described herein, by a hob having the features as described herein, and by cookware having the features as described herein. Advantageous embodiments and developments of the invention can be found herein.

The invention thus relates to a method for operating a cooking system, preferably an inductive cooking system, the cooking system having a hob, cookware and a mobile device, the method comprising the steps of:

transmitting a process instruction from the mobile device to the hob, receiving the process instruction from the mobile device by means of the hob, transmitting a confirmation request from the hob to the cookware, in response to a confirmation by a user on the cookware, transmitting a confirmation message from the cookware to the hob, and in response to the hob receiving the confirmation message from the cookware, executing the process instruction of the mobile device by means of the hob.

A user can carry out the confirmation on the cookware by means of a confirmation element in the form of a control element such as a touch-sensitive button or the like. The confirmation element can preferably be arranged on a handle element or the like of the cookware but can also be arranged on the cookware independently of a handle element. In any case, the confirmation element can be designed to be sufficiently protected or sealed in order to make the cookware washable and in particular dishwasher-safe. The confirmation element can preferably be supplied with energy via energy harvesting, for example from the induction circuit of an induction hob, but also by means of a battery or a rechargeable battery.

In other words, the previously known confirmation of a process instruction of a cooking recipe and the like, which, for example, runs as an app on a mobile device such as a smartphone or tablet, can be moved from the hob onto the cookware, such as a pan, pot, kettle, immersion heater or immersion target and the like. However, the mobile device can also be a projection or a display of another fitted appliance or the like. As a result, the confirmation can be kept at the site of the event since this is necessary to prevent a remote effect. However, assigning may be easier, clearer and/or more intuitive for a user if they confirm a process instruction directly on the corresponding cookware rather than centrally on the hob. This can increase the convenience of supporting a cooking process by means of a mobile device while at the same time preventing a remote effect.

An immersion heater, also referred to as an immersion target, is a rod having a handle portion formed on a first end and an inductor, also referred to as a target, formed on the opposite second end. The inductor is a metal plate which can be inductively heated by an alternating electromagnetic field. The immersion heater can be placed in a vessel which is not suitable for inductive heating, such as a drinking glass or a porcelain jug. The immersion heater enters the food or the food surrounds the immersion heater. If the vessel, with the immersion heater, is placed on a hotplate of an induction hob, the food can be heated by the inductive heating of the immersion heater.

According to one aspect of the invention, in response to the cookware receiving the confirmation request from the hob, the cookware prompts the user to carry out the confirmation. In this way, the user can be made aware that their confirmation is required for the continuation of the cooking process. At the same time, the user can thus directly identify which cookware requires confirmation, since the confirmation is requested by precisely that cookware. This can make the assignment of the step of the cooking process that is to be confirmed to the relevant cookware simple, clear and/or intuitive for the user.

According to a further aspect of the invention, the cookware prompts the user to carry out the confirmation optically, acoustically and/or haptically. Lighting functions on the cookware that can illuminate, flash, pulse, change color and the like, in order for the cookware to prompt the user to carry out the confirmation, are in particular considered as optical means. Tones or tone sequences which are output or changed by the cookware to prompt the user to carry out the confirmation can preferably be suitable as acoustic means. A vibration of the cookware or a part thereof, such as the handle of a pan or the handles of a pot, can preferably take place as a haptic means.

According to a further aspect of the invention, in response to the cookware receiving the confirmation request from the hob, a confirmation element of the cookware is activated. In this way, the corresponding confirmation element can only be activated when the confirmation element is also intended to be actuated. This can prevent erroneous input by the user at other times. Energy can also be saved by not operating the confirmation element unnecessarily early. This can be particularly relevant since energy usually has to be supplied to the cookware from the outside in order to be able to carry out the method according to the invention.

According to a further aspect of the invention, in response to a successful pairing of the hob and the cookware, a confirmation element of the cookware is activated. Alternatively, the confirmation element can be activated as soon as a pairing has been established between the hob and the cookware. If the confirmation element is, for example, illuminated in this case, the successful pairing of the hob and the cookware can also be indicated to the user in this way.

According to a further aspect of the invention, after a predetermined period of time has elapsed, the prompting of the user by the cookware to carry out the confirmation changes, and/or the user is informed about the expiry of the predetermined period of time by the cookware, and/or the prompting of the user by the cookware to carry out the confirmation ends.

In other words, after a predetermined period of time has expired, which period of time can depend on the relevant step of the cooking process, the prompting measures can be changed without a successful confirmation by the user on the cookware. As a result, for example, an optical means such as a luminous confirmation element can start to flash, or the frequency and/or intensity of an already-flashing confirmation element can be increased. Additionally or alternatively, an acoustic means can be changed or can only now be supplemented with an optical means. This can also apply to a haptic means. In any case, an attempt can thus be made to attract the user's attention to a greater extent than before and to indicate to said user the increasing urgency of carrying out a confirmation on the cookware.

Additionally or alternatively, the user can be informed, for example via a display and/or an acoustic output, that time has already passed, or how much time has already passed, since the confirmation was to be carried out. A remaining period of time which is still available for confirmation can also be indicated.

Additionally or alternatively, the prompting of the user can be ended. This can be the case, for example, if the measure which is currently to be carried out and confirmed on the cookware according to the cooking process or according to the cooking recipe is no longer to be carried out or can no longer be carried out due to the elapsed period of time. These steps are preferably carried out after different predetermined periods of time, such that, for example, the prompting can first be changed or intensified and can only be ended later.

According to a further aspect of the invention, in response to the process instruction being sent from the mobile device to the hob, the mobile device prompts the user to carry out the confirmation. In other words, the user can also be informed by the mobile device or the app thereof that a confirmation is to be carried out on the cookware. This can increase or improve the possibilities of attracting the user's attention and carrying out the confirmation.

According to a further aspect of the invention, the mobile device prompts the user to carry out the confirmation optically, acoustically and/or haptically. This allows the mobile device to carry out measures comparable to those described above with regard to the cookware in order to draw the user's attention, which measures will therefore not be repeated here.

According to a further aspect of the invention, after a predetermined period of time has elapsed, the prompting of the user by the mobile device to carry out the confirmation changes, and/or the user is informed about the expiry of the predetermined period of time by the mobile device, and/or the prompting of the user by the mobile device to carry out the confirmation ends.

This allows the mobile device to carry out measures comparable to those described above with regard to the cookware in order to react to the absence of the confirmation by the user over a predetermined period of time, which measures will therefore not be repeated here.

According to a further aspect of the invention, in response to the user confirming the process instruction of the mobile device on the hob, the process instruction of the mobile device is executed. In other words, in parallel with the confirmation according to the invention on the cookware, the previously known option of the user carrying out the confirmation on the hob can be retained and additionally offered to the user. The user can thus choose whether they would like to carry out the confirmation on the hob or on the cookware. This can increase the convenience of operation for the user.

According to a further aspect of the invention, in response to the hob receiving the confirmation message from the cookware or in response to the user confirming the process instruction of the mobile device on the hob, a confirmation notification is transmitted from the hob to the mobile device, and, in response to the mobile device receiving the confirmation notification from the hob, a notification is output from the mobile device to the user that the process instruction of the mobile device has been confirmed on the cookware or on the hob. In this way, the mobile device can inform the user that their confirmation has been carried out on the cookware or on the hob. The confirmation notification or the notification to the user resulting therefrom can preferably also contain information as to whether the confirmation by the user was carried out on the cookware or on the hob. Furthermore, in response to the mobile device receiving the confirmation notification from the hob, the mobile device or the app thereof can proceed to the next step of a cooking process if necessary.

The invention also relates to a hob for carrying out a method as described above. In this way, a hob can be provided in order to allow the method according to the invention described above to be carried out with the properties and advantages thereof.

The invention also relates to cookware for carrying out a method as described above. In this way, cookware can be provided in order to allow the method according to the invention described above to be carried out with the properties and advantages thereof.

An embodiment of the invention is shown in the drawings in a purely schematic manner and will be described in more detail below. In the drawings:

The above figures are viewed in Cartesian coordinates. A longitudinal direction X extends, which can also be referred to as the depth X or length X. A transverse direction Y, which can also be referred to as the width Y, extends perpendicularly to the longitudinal direction X. A vertical direction, which can also be referred to as the height, extends perpendicularly both to the longitudinal direction X and to the transverse direction Y.

FIG. 1 is a schematic view of a cooking system 1, 2, 3 for carrying out a method according to the invention from above. The cooking system 1, 2, 3 consists of a hob 1, cookware 2 and a mobile device 3.

The hob 1 is an inductive hob 1 and has a total of five hotplates 10. Furthermore, a control/display element 11 is provided that has a confirmation element 12. Cookware 2, which includes a pan 2*a*, a cooking pot 2*b* and a kettle 2*c*, are arranged on three of the five hotplates 10. Each piece of cookware 2 in turn has a confirmation element 20 on the handle or lid. The mobile device 3 can also be referred to as a mobile terminal 3 and can in particular be a smartphone 3 or a tablet 3, on which an app for carrying out a cooking process can run.

Figure 2:
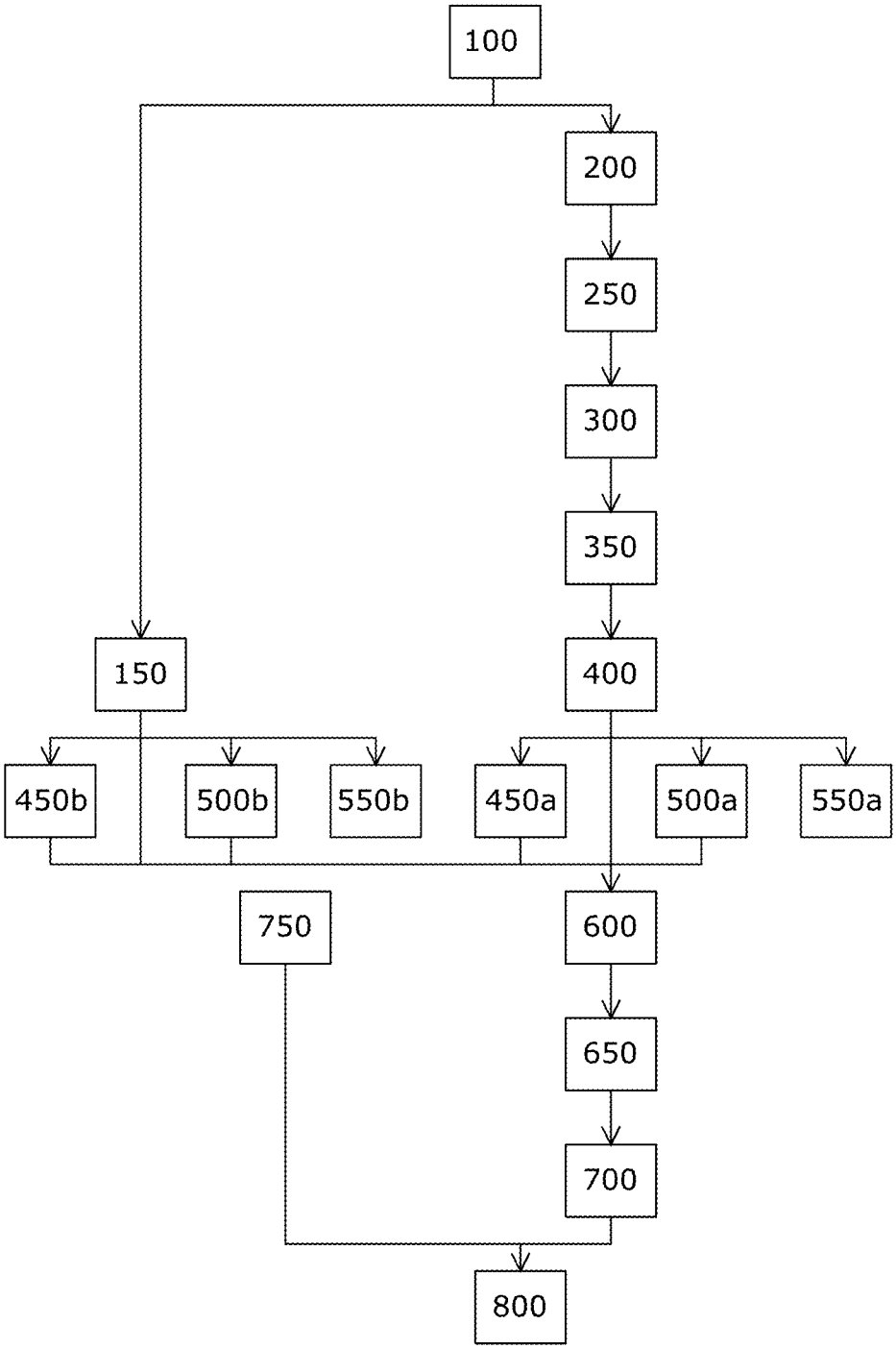
FIG. 2 is a flowchart of a method according to the invention.

By means of the cooking system 1, 2, 3, a method according to the invention, as shown in the flowchart in FIG. 2, can proceed as follows:

If a point is reached in the course of the cooking process of the app of the mobile device 3 at which a change, for example in the power level of the hotplate 10 of the corresponding cookware 2, is required and should be implemented by the hob 1, then this, as previously known, is to be confirmed on the hob 1 by means of the confirmation element 12 thereof or, alternatively, according to the invention, on the confirmation element 20 of the corresponding cookware 2.

For this purpose, a process instruction can be transmitted 100 from the mobile device 3 to the hob 1, which can be received there by the hob 1 receiving 200 the process instruction from the mobile device 3.

The hob 1 can now transmit 250 a confirmation request to the cookware 2, which can be received there by the cookware 2 receiving 300 the confirmation request from the hob 1. The confirmation element 20 of the cookware 2 can then be activated 350. Alternatively, this can also have already taken place in response to a successful pairing of the hob 1 and the cookware 2. Furthermore, the cookware 2 can prompt 400 the user to carry out the confirmation 600. For this purpose, for example, the activated confirmation element 20 can begin to illuminate.

After a predetermined period of time has elapsed without the user carrying out the confirmation 600 on the cookware 2, the prompting 400 of the user by the cookware 2 to carry out the confirmation 600 can be changed 450*a* by the illumination of the confirmation element 20 changing to a brighter illumination or changing to flashing, in order to be able to better draw the user's attention. If necessary, the cookware 2 can also inform 500*a* the user about the expiry of the predetermined period of time, for example using text via a corresponding display.

If there is no confirmation 600 by the user on the cookware 2, even after a longer predetermined period of time, the prompting 400 of the user by the cookware 2 to carry out the confirmation 600 can be ended 550*a*. The lack of confirmation 600 can also be detected by the mobile device 3 and reacted to by means of an alternative step of the cooking process.

In parallel, in response to the transmission 100 of the process instruction from the mobile device 3 to the hob 1, the mobile device 3 can prompt 150 the user to carry out the confirmation 600 in order to draw the user's attention to the confirmation 600 in this way. In addition, by means of the mobile device 3 or the app thereof, the prompting 150 of the user by the mobile device 3 to carry out the confirmation 600 can be changed 450*b*, the user can be informed 500*b* about the expiry of the predetermined period of time by the mobile device 3, and/or the prompting 150 of the user by the mobile device 3 to carry out the confirmation 600 can be ended 550*b*.

If the user carries out the confirmation 600 on the cookware 2, a confirmation message is sent 650 from the cookware 2 to the hob 1, which can be received there by the hob 1 receiving 700 the confirmation message from the cookware 2. This can lead to the hob 1 executing 800 the process instruction of the mobile device 3. Alternatively, this can also take place by the user confirming 750 the process instruction of the mobile device 2 on the hob 1 by means of the confirmation element 12 thereof.

In response to the hob 1 receiving 700 the confirmation message from the cookware 2 or in response to the user confirming 750 the process instruction of the mobile device 2 on the hob 1, a confirmation notification can also be transmitted 850 from the hob 1 to the mobile device 3. In response to the mobile device 3 receiving 900 the confirmation notification from the hob 1, a notification of the mobile device 3 can be output 950 to the user that the process instruction of the mobile device 2 has been confirmed 750 on the cookware 2 or on the hob 1. This can be differentiated if necessary.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS (PART OF THE DESCRIPTION)

X longitudinal direction; depth; length
Y transverse direction; width
1 (inductive) hob
10 hotplates
11 control/display element
12 confirmation element
2 cookware
2*a* pan
2*b* cooking pot
2*c* kettle
20 confirmation elements
3 mobile device; mobile terminal; smartphone; tablet
100 transmitting process instruction from mobile device 3 to hob 1
150 prompting user by means of mobile device 3 to carry out confirmation 600
200 receiving process instruction from mobile device 3 by means of hob 1
250 transmitting confirmation request from hob 1 to cookware 2
300 receiving confirmation request from hob 1 by means of cookware 2
350 activating confirmation element 12 of cookware 2
400 prompting user by means of cookware 2 to carry out confirmation 600
450*a* changing prompting 400 of user by cookware 2 to carry out confirmation 600
500*a* informing user about expiry of predetermined period of time by means of cookware 2
550*a* ending prompting 400 of user by cookware 2 to carry out confirmation 600
450*b* changing prompting 150 of user by mobile device 3 to carry out confirmation 600
500*b* informing user about expiry of predetermined period of time by means of mobile device 3
550*b* ending prompting 150 of user by mobile device 3 to carry out confirmation 600
600 confirmation by user on cookware 2
650 transmitting confirmation message from cookware 2 to hob 1
700 receiving confirmation message from cookware 2 by means of hob 1
750 confirmation of process instruction of mobile device 2 by user on hob 1
800 executing process instruction of mobile device 3 by means of hob 1
850 transmitting confirmation notification from hob 1 to mobile device 3
900 receiving confirmation notification from hob 1 by means of mobile device 3
950 outputting notification from mobile device 3 to user

The invention claimed is:

1. A method for operating a cooking system, the cooking system comprising a hob, cookware, and a mobile device, the method comprising:

transmitting a process instruction from the mobile device to the hob;

receiving the process instruction from the mobile device by the hob;

transmitting a confirmation request from the hob to the cookware;

receiving the confirmation request from the hob by the cookware;

in response to the cookware receiving the confirmation request from the hob, prompting a user by the cookware to carry out the confirmation;

carrying out the confirmation on the cookware by the user;

in response to the confirmation on the cookware confirming the process instruction by the user, transmitting a confirmation message from the cookware to the hob;

receiving the confirmation message from the cookware by the hob; and in response to the hob receiving the confirmation message from the cookware, executing the process instruction of the mobile device by the hob.

2. The method of claim 1, wherein the cookware prompts the user to carry out the confirmation at least one of optically, acoustically, or haptically.

3. The method of claim 1, further comprising:

in response to the cookware receiving the confirmation request from the hob, activating a confirmation element of the cookware.

4. The method of claim 1, further comprising:

in response to a successful pairing of the hob and the cookware, activating a confirmation element of the cookware.

5. The method of claim 1, further comprising:

after a predetermined period of time has expired, at least one of:

changing the prompting of the user by the cookware to carry out the confirmation, informing the user about an expiry of the predetermined period of time by the cookware, or ending the prompting of the user by the cookware to carry out the confirmation.

6. The method of claim 1, further comprising:

in response to the transmission of the process instruction from the mobile device to the hob, prompting the user by the mobile device to carry out the confirmation.

7. The method of claim 6, wherein the mobile device prompts the user to carry out the confirmation at least one of optically, acoustically, or haptically.

8. The method of claim 6, further comprising:

after a predetermined period of time has expired, at least one of:

changing the prompting of the user by the mobile device to carry out the confirmation, informing the user about an expiry of the predetermined period of time by the mobile device, or ending the prompting of the user by the mobile device to carry out the confirmation.

9. The method of claim 1, further comprising:

in response to the user confirming the process instruction of the mobile device on the hob, executing the process instruction of the mobile device.

10. The method of claim 1, further comprising:

in response to the hob receiving the confirmation message from the cookware or in response to the user confirming the process instruction of the mobile device on the hob, transmitting a confirmation notification from the hob to the mobile device; and in response to the mobile device receiving the confirmation notification from the hob, outputting a notification from the mobile device to the user that the process instruction of the mobile device has been confirmed on the cookware or on the hob.

11. A hob for carrying out the method of claim 1.

12. A cookware for carrying out the method of claim 1.

13. The method of claim 1, wherein the cooking system comprises an inductive cooking system.

* * * * *